United States Patent [19]

Fox

[11] 4,375,492

[45] Mar. 1, 1983

[54] DIELECTRIC RECORD MATERIAL

[75] Inventor: Richard E. Fox, Dayton, Ohio

[73] Assignee: Appleton Papers Inc., Appleton, Wis.

[21] Appl. No.: 266,565

[22] Filed: May 22, 1981

[51] Int. Cl.[3] ..... B41M 5/20

[52] U.S. Cl. ..... 428/212; 162/138; 282/27.5; 346/135.1; 427/121; 428/211; 428/320.4; 428/320.8; 428/511; 428/913

[58] Field of Search ..... 162/138, 162; 282/27.5; 346/135.1, 157; 427/121; 428/211, 537, 913, 195, 207, 209, 212, 484, 488, 500, 507, 511–514, 522, 320.4, 320.6, 320.8

[56] References Cited

U.S. PATENT DOCUMENTS 3,905,876 9/1975 Yoshino et al. ..... 346/135.1

4,028,118 6/1977 Nakasuju et al. ..... 428/913

FOREIGN PATENT DOCUMENTS 52-73048 6/1977 Japan ..... 427/121

*Primary Examiner*—Bruce H. Hess

*Attorney, Agent, or Firm*—E. Frank McKinney; Paul S. Phillips, Jr.

[57] ABSTRACT

A reactive dielectric record material is disclosed which comprises certain chromogenic material and certain phenolic material. This record material produces images by means of a dielectric process wherein two color-forming agents contained within a reactive image-bearing surface are brought into reactive, color-producing contact by means of colorless toner material.

11 Claims, No Drawings

DIELECTRIC RECORD MATERIAL

TECHNICAL FIELD

This invention pertains to electrographic copy and printing methods. It more particularly relates to novel reactive or self-contained dielectric imaging sheets.

The invention also particularly concerns clean and non-polluting electrographic imaging components.

BACKGROUND ART

Two commonly employed electrostatographic copying and printing processes are the electrophotographic or xerographic process and the dielectric or electrographic process. In the electrophotographic process an electrostatic image is formed on a photoconductive insulating surface by charging the surface and exposing it to an image of light and shadow to be recorded, whereupon the electric charge is dissipated in the light areas. The image is then developed by applying pigment material to the image-bearing surface. Depending upon the nature of the process, the developed image is then either fixed on the original photoconducting surface or transferred to a final image support member and fixed.

In the dielectric process an electrostatic image is applied to a conductive image support member coated with an insulating dielectric layer. The image pattern is generated by way of an electrically energized stylus or an electrostatic writing tube (commonly referred to as a CRT pin-tube) which is in close proximity to the dielectric layer. Energizing of the stylus or the electrostatic writing tube results in the deposition of a charge pattern on the surface of the dielectric layer, commonly referred to as a latent image. The latent image is developed by depositing pigment materials onto the image-bearing surface and the developed image is fixed by bonding the pigment materials to the surface.

A xerographic developing material comprising an encapsulated color-forming composition within a shell having surface triboelectric properties suitable for electrostatic deposition is disclosed in U.S. Pat. No. 3,080,251. The said color-forming composition can comprise basic chromogenic lactone compounds. The color-forming composition, released by means of pressure, reacts with an acidic adsorbent photoconductive material which is required.

An electrophotographic method which comprises developing a latent image formed on a photosensitive member comprising a photoconductive material and a color-forming agent (B) with a toner comprising a color-forming agent (A) is disclosed in U.S. Pat. Nos. 3,879,196, 3,880,656, 4,054,712 and 4,148,968. Phenolic materials are disclosed as examples of color-forming agents (A) and basic chromogenic lactone compounds are disclosed as examples of color-forming agents (B). The disclosure contemplates only electrophotographic processes; dielectric processes are neither disclosed or suggested.

In all of the above-disclosed processes, only one of the color-forming agents resides in the final image support member. The other component of the color-forming reactant pair is contained within the toner material.

Heat-sensitive mark-forming systems, wherein both components of the color-forming reaction are contained within the color-forming layer, have been disclosed in U.S. Pat. No. 3,539,375. When the reactive components of such heat-sensitive mark-forming systems are incorporated into a reactive dielectric record material, a dark, prematurely colored product results.

Pressure-sensitive mark-forming systems, wherein both components of the color-forming reaction are contained within the color-forming layer, have been disclosed in U.S. Pat. No. 4,197,346. These pressure-sensitive mark-forming systems, wherein both color-forming components reside within a single color-forming layer, are called self-contained systems. In these prior art self-contained systems, colored images are formed as a result of the intermixing of the color-forming components as a consequence of microcapsule rupture brought about by the application of writing or impact pressures.

Thermochromic material exhibiting reversible metachromism and comprising (A) an electro-donating chromatic organic component, (B) a compound having a phenolic hydroxyl group, (C) higher aliphatic monovalent alcohols and (D) higher monovalent acid alcohol esters is disclosed in U.S. Pat. No. 4,028,118. The chromatic organic compound can include crystal violet lactone and the phenolic compound can include phenolphthalein.

DISCLOSURE OF THE INVENTION

In the best of applicant's knowledge, self-contained color-forming electrographic copying systems are not known. The electrographic copying systems employing color-forming agents for the development of a visible image all suffer from the defect of inefficiency of color formation resulting from the bringing of one color-forming component from a remote area to the image-bearing surface.

It is an object of the present invention to provide an electrographic copying system wherein the visible image is formed by the reaction of two color-forming agents contained within a self-contained image-bearing surface.

It is also an object of the present invention to provide an electrographic copying process comprising a reactive, self-contained image-bearing surface wherein a colorless toner is employed.

It is a further object of the present invention to provide an electrographic copying system which utilizes substantially colorless, low cost, non-toxic, stable and clean toners.

It is yet another object to provide a dielectric copying process which utilizes a reactive, self-contained image-forming surface.

It is still another object to provide a reactive, self-contained dielectric image-forming record material.

The dielectric color-forming record material of this invention comprises an insulating layer, including basic chromogenic material and acidic phenolic material, disposed on a conductive substrate. The record material of this invention performs the functions of charge acceptance and color formation. The color-forming system relies upon mutual solution or melting with the aid of one or more toner components to achieve reactive, color-producing contact. This color-producing step is equivalent to the image fixing step in conventional dielectric copying processes. This color production is achieved by subjecting the toned (developed) image to heat or to solvent vapors.

The color-forming system of the record material of this invention comprises one or more basic chromogenic materials and one or more acidic phenolic materials.

The preferred basic chromogenic materials useful in this invention are compounds such as, for example, those disclosed in U.S. Pat. Nos. Re 23,024, 3,491,111, 3,491,112, 3,491,116, 3,509,173, 3,509,174, 3,627,787, 3,637,757, 3,681,390, 3,775,424 and 3,853,869.

More preferred among the basic chromogenic compounds found useful in the present inventions are the phthalides, pyridinones and fluorans.

Still more preferred among the compounds found useful in the present invention are 3,3-bis(4-dimethylaminophenyl)-6-dimethylaminophthalide (Crystal Violet Lactone, CVL), an isomeric mixture of 7-(1-ethyl-2-methylindol-3-yl)-7-(4-diethylamino-2-ethoxyphenyl)-5,7-dihydrofuro[3,4-b]pyridin-5-one and 5-(1-ethyl-2-methylindol-3-yl)-5-(4-diethylamino-2-ethoxyphenyl)-5,7-dihydrofuro[3,4-b]pyridin-7-one (Pyridyl Blue, disclosed in U.S. application Ser. No. 45,769, filed June 5, 1979), 2'-anilino-6'-diethylamino-3'-methylfluoran (N-102), and 3,3-bis(1-ethyl-2-methylindol-3-yl)phthalide (Indolyl Red), used individually or in mixtures.

Most preferred among the basic chromogenic compounds found useful in this invention is a mixture of Pyridyl Blue and N-102, with N-102 present in the majority.

The preferred acidic phenolic materials useful in this invention are phthaleins and resorcinol monobenzoate. More preferred among the phenolic materials useful in this invention are phthaleins. Most preferred among the acidic phenolic materials useful in this invention is phenolphthalein.

The color-forming components of the record material of this invention are in a contiguous relationship, substantially homogeneously distributed through the insulating dielectric layer. The record material is selectively charged and toned with a colorless toner. A colored image is developed and fixed by the application of heat or by exposure to selected solvent vapors.

In the preferred construction, the insulating layer of the record material of this invention comprises one or more basic chromogenic materials and acidic phenolic material. The insulating layer can also contain one or more pigment materials such as, for example, kaolin clay, calcium carbonate and titanium dioxide. In manufacturing the record material, a coating composition is prepared which contains one or both of the color-forming components in dispersion. The preferred dispersion liquid is water, but organic solvents can be alternatively used. One but not both of the color-forming components can be in solution in the dispersion liquid. The insulating layer coating composition is applied to a conductive substrate. Conventional paper coating base stocks can be made conductive by the application of a conductive polymer solution such as 261LV sold by Merck Paper Chemicals or Nalco 8674, a cationic electroconductive polymer sold by Nalco Chemical Company, Oak Brook, IL. Additional methods of making conductive substrates are disclosed in U.S. Pat. Nos. 3,075,859, 3,348,970 and 3,639,640.

Examples of dielectric insulating materials and proper parameters for the dielectric layer are disclosed in U.S. Pat. Nos. 3,110,621, 3,639,640 and 4,165,686.

The following examples are given merely as illustrative of the present invention and are not to be considered as limiting.

CONDUCTIVE BASE PAPER EXAMPLE

A conductive coating formulation of about 8% solids and comprising a cationic polyamine electroconductive resin (Nalco 8674, made by Nalco Chemical Co., Oak Brook, IL) was applied to a 38 pound per ream (3,300 square feet) base sock, using an air knife coater, and subsequently dried. The dried coat weight of the conductive cationic polyamine was about one pound per ream (3,300 square feet).

REACTIVE DIELECTRIC MATERIAL EXAMPLES

Example 1

A mixture of

| | | |
|---|---|---|
| 30.0 | grams | distilled water |
| 1.303 | grams | phenolphthalein |
| 0.653 | grams | Crystal Violet Lactone (CVL) |
| 0.031 | gram | Nopco NDW (defoaming agent, Nopco Chemical Company, Newark, NJ) |
| 0.014 | gram | Surfynol 104 (di-tertiary acetylene glycol, Air Reduction Chemical Co., Allentown, PA) |

was ground in a polyethylene jar with steel shot for about one hour. The dispersion was filtered, washed with water and the filter cake was mixed with

| | | |
|---|---|---|
| 24.0 | grams | acrylic latex emulsion (H77VC39 33% solids, Sherwin-Williams Company, Cleveland, OH) |

The mixture was coated on a conductive base (as described in the conductive base example) using a #9 wire-wound coating rod. The coating was dried in an oven at about 47° C., resulting in a dry coat weight of 6.0 lbs. per ream (3300 square feet).

Examples 2–9

Following substantially the same procedure as Example 1, additional reactive dielectric record material examples were prepared using water as the dispersion liquid. Listed in Table 1 are the example numbers and the corresponding type and quantity of basic chromogenic compound(s), the quantity of phenolphthalein and the quantity of acrylic latex emulsion employed in the respective examples. All quantities are expressed in Table 1 as weight-percent on a solids basis and do not take into account the small amounts of dispersant and defoamer present. All coat weights are expressed as lbs. per ream (25 in.×38 in.—500 sheets, 3300 square feet).

TABLE 1

Reactive Dielectric Record Material

| Example No. | Chromogenic Material Type | Chromogenic Material Amount | Amount Phenophthalein | Amount Acrylic latex emulsion | Total Dry Coat Weight |
|---|---|---|---|---|---|
| 2 | Pyridyl Blue | 6.6% | 13.2% | 80.2% | 6.1 |
| 3 | N-102 | 6.8% | 13.1% | 80.1% | 5.7 |
| 4 | Indolyl Red | 7.2% | 13.0% | 79.8% | 6.0 |
| 5 | Pyridyl Blue | 3.0% | 13.1% | 80.1% | 5.8 |
| | N-102 | 2.2% | | | |
| | Indolyl Red | 1.6% | | | |
| 6 | Pyridyl Blue | 2.2% | 13.1% | 80.1% | 5.6 |
| | N-102 | 4.5% | | | |
| 7 | CVL | 2.5% | 28.7% | 63.0% | 5.2 |
| | N-102 | 5.8% | | | |
| 8 | Pyridyl Blue | 5.7% | 28.5% | 65.8% | not |

TABLE 1-continued

| Reactive Dielectric Record Material | | | | | |
|---|---|---|---|---|---|
| Example No. | Chromogenic Material Type | Chromogenic Material Amount | Amount Phenophthalein | Amount Acrylic latex emulsion | Total Dry Coat Weight |
| 9 | Pyridyl Blue N-102 | 2.8% 5.5% | 27.7% | 63.9% | determined 5.6 |

Example 10

A mixture (Mixture A) of

| | | |
|---|---|---|
| 120 | grams | phenolphthalein |
| 60 | grams | carboxylated vinyl acetate copolymer (20% solids, Resyn 28-1300, National Starch and Chemical Corp., Bridgewater, NJ) |
| 220 | grams | water |

was dispersed in a laboratory Szegvari attritor (a particle size reducing apparatus made by Union Processes Co.) for about one hour.

A mixture (Mixture B) of

| | | |
|---|---|---|
| 120 | grams | Crystal Violet Lactone |
| 20 | grams | Resyn 28-1300 solution, 20% solids |
| 220 | grams | water |

was dispersed in a laboratory Szegvari attritor for about one hour.

A mixture of

| | | |
|---|---|---|
| 10 | parts | Mixture B |
| 50 | parts | Mixture A |
| 100 | parts | acrylic latex emulsion (33% solids, H77VC39) |

was prepared, coated and the coating dried.

Example 11

In this example of the preparation of a reactive dielectric record material, a dispersion of a phenolic material (Component A) and a solution of a basic chromogenic material (Component B) were prepared in an organic solvent medium, mixed and applied to one side of a conductive base paper.

| Component A | | |
|---|---|---|
| 5 | grams | phenolphthalein |
| 50 | grams | toluene |

The Component A mixture was milled on a roller mill in a Roalox Jar using one-half inch diameter cylindrical media for about two hours to disperse the phenolphthalein in the toluene.

| Component B | | |
|---|---|---|
| 3.5 | grams | polystyrene (Styron 690, manufactured by Dow Chemical Company) |
| 1.5 | grams | ethyl methacrylate resin (Elvacite 2042 manufactured by the duPont Company) |
| 0.5 | gram | Crystal Violet Lactone |
| 20.0 | grams | toluene |

The dispersion of Component A was poured into the solution of Component B. The resulting pale blue dispersion was applied to one side of conductive base paper using a No. 18 wire-wound coating rod and the resulting coating was air dried.

Example 12

A mixture of

| | | |
|---|---|---|
| 0.02 | gram | Pyridyl Blue |
| 0.40 | gram | resorcinol monobenzoate |
| 4.0 | grams | of a solution of: 0.4 parts chlorinated rubber (Parlon S-20 manufactured by Hercules Powder Co.) 0.6 parts polystyrene (Styron 690) 9.0 parts toluene |

was applied to one side of conductive base paper using a No. 18 wire-wound coating rod and the resulting coating was oven dried at about 50° C.

The toner compositions which function with the reactive dielectric record material of the invention to produce visible images include dry fatty acid amide particles, dispersions of dry fatty acid amide particles, particles of colloidal silica on which is adsorbed a glycol, emulsions of a glycol in an organic liquid, emulsions of water in an organic liquid and dispersions of microcapsules wherein the contents of the microcapsules comprise water or a glycol-water mixture.

TONER COMPOSITION EXAMPLES

Example 13

Into a mixture of

| | | |
|---|---|---|
| 125.0 | grams | Soltrol 100 (Paraffin hydrocarbon, manufactured by Phillips Petroleum Company) |
| 2.0 | grams | Aerosil 972 (silicon dioxide 10–40mμ, Degussa Inc.) |

after stirring, was added

| | | |
|---|---|---|
| 40.0 | grams | propylene glycol |
| 0.4 | gram | Adogen 471 (cationic surfactant, Archer-Daniels-Midland Co.) |

and the mixture was emulsified for about 10 minutes in a Waring Blendor cup with a Polytron head.

Example 14

The procedure of Example 13 was repeated with the exception that distilled water was substituted for propylene glycol.

Example 15

Kemamide S (Stearamide, Humko-Sheffield Chemicals, Memphis, TN) was sieved through a Thermofax carrier screen (Minnesota Mining and Manufacturing Company, St. Paul, MN). The particles passing through the screen were used as toner material.

Example 16

A mixture of

| | | |
|---|---|---|
| 201.0 | grams | distilled water |

-continued

| | | |
|---|---|---|
| 1.0 | gram | Adogen 471 |
| 10.0 | grams | Kemamide S |

was stirred for about 45 minutes and the mixture was allowed to stand overnight. The Kemamide S particles were separated from the liquid and dried in a warm oven. The dry material was crushed and the resulting particles were used as toner material.

Example 17

The procedure of Example 16 was repeated, except with the following quantities:

| | | |
|---|---|---|
| 400 | grams | distilled water |
| 2.28 | grams | Adogen 471 |
| 20.1 | grams | Kemamide S |

Example 18

A mixture of

| | | |
|---|---|---|
| 1.0 | gram | propylene glycol |
| 3.0 | grams | Syloid 74 (synthetic silica, Davison Chemical Corp.) |
| 10.0 | grams | acetone |

was stirred and the acetone allowed to evaporate. The remaining solid was placed in a 40° C. oven to complete the removal of the acetone. The resulting free flowing powder of propylene glycol adsorbed on silica gel was used as toner material.

Example 19

A mixture of

| | | |
|---|---|---|
| 20 | parts | Kemamide B (Behenamide, Humko-Sheffield Chemicals, Memphis, TN) |
| 100 | parts | Isopar G (paraffin hydrocarbon manufactured by Exxon Corp.) |

was dispersed in a laboratory Szegvari attritor for 30 to 45 minutes. One part of the above dispersion was diluted with 5 to 10 parts of Isopar G.

Toner Example 20

In this example the toner comprised a dispersion of capsules containing a mixture of propylene glycol and water. The capsules were prepared by the method described in U.S. Pat. No. 3,674,704.

A mixture of

| | | |
|---|---|---|
| 5 | grams | partially hydrolyzed ethylene co-vinyl acetate resin |
| 150 | ml | toluene |

was heated and stirred to dissolve the resin. The solution was cooled and into it was emulsified a mixture of 50 grams propylene glycol
50 grams distilled water While the emulsion was stirred at room temperature, the following mixture was added dropwise over a period of 80 minutes.

50 ml cottonseed oil
50 ml toluene

The mixture was stirred overnight at room temperature and the next day the following mixture was added 10 ml Mondur CB
20 ml toluene Mondur CB-75 is a toluene diisocyanate adduct of trimethanol propane and is sold by the Mobay Chemical Company, Pittsburgh, Pa.

The resulting mixture was stirred six hours and sufficient toluene was added to bring the total emulsion volume to 315 ml. After the emulsion was stirred overnight, allowed to settle and decanted, a series of three washings, each followed by decantation, was performed on the capsular product. The first washing was with a 1:1 toluene:Isopar G mixture and the last two were performed with pure Isopar G. The final capsule product was stored in 100 ml of Isopar G.

EXAMPLES OF IMAGING WITH REACTIVE DIELECTRIC RECORD MATERIAL SHEETS

The following is an example of a procedure used to produce an image on reactive dielectric record material of Example 8 using toner material Example 17.

Reactive dielectric record material sheet Example 8 was placed on a ground conductive substrate with the dielectric layer on the side opposite the conductive substrate. A metal type wheel, to which had been applied a 500 volt potential with a DC power supply, was advanced across the said dielectric layer forming a latent charged image. Toner material of Example 17 was adapted to the dielectric layer, the sheet was moved in such a manner to cause the toner particles to tumble back and forth (cascade) across the surface of the dielectric coating and the sheet was then shaken to remove the excess, unattached toner powder. The sheet was heated to 120°–150° C. A dense, blue well-defined image was formed.

In a similar manner, latent electrostatic images were applied to the reactive dielectric record material sheets of Examples 1–7 and 9–12. These sheet Examples are listed in Table 2. Listed opposite each sheet Example is the toner Example utilized, the method used to fix the toned (developed) images and the results observed. In the cases where a liquid toner material was used, the electrostatic imaged dielectric record material sheet was immersed in the liquid toner and the excess toner was allowed to drain off prior to the application of the fixing method.

TABLE 2

| Reactive Dielectric Sheet Example | Toner Example | Fixing Method | Results |
|---|---|---|---|
| 1 | 13 | Exposure to acetone vapor | Intense blue image |
| 1 | 13 | Application of heat, 100° C. | Blue image, very low background development |
| 1 | 14 | Exposure to acetone vapor | Blue image |
| 2 | 13 | Exposure to acetone vapor | Intense blue image |
| 2 | 13 | Application of heat, 100° C. | Intense blue image, very low background development |
| 2 | 14 | Exposure to acetone vapor | Sharp blue image |
| 2 | 15 | Application of heat, 120–140° C. | Blue image |

TABLE 2-continued

| Reactive Dielectric Sheet Example | Toner Example | Fixing Method | Results |
|---|---|---|---|
| 3 | 13 | Exposure to acetone vapor | Black image |
| 3 | 13 | Application of heat, 100° C. | Black image, very low background development |
| 3 | 14 | Exposure to acetone vapor | Black image |
| 4 | 13 | Exposure to acetone vapor | Intense red image |
| 4 | 13 | Application of heat, 100° C. | Red image |
| 4 | 14 | Exposure to acetone vapor | Red image |
| 5 | 13 | Exposure to acetone vapor | Dark purple image |
| 5 | 13 | Application of heat, 100° C. | Purple image, very low background development |
| 5 | 14 | Exposure to acetone vapor | Purple image |
| 5 | 15 | Application of heat, 120–140° C. | Purple image, very low background development |
| 6 | 13 | Exposure to acetone vapor | Intense purple image |
| 6 | 13 | Application of heat, 100° C. | Intense purple image, low background development |
| 6 | 14 | Exposure to acetone vapor | Purple image |
| 7 | 16 | Application of heat, 130–150° C. | Sharp black image, low background development |
| 8 | 17 | Application of heat | Intense blue image |
| 9 | 15 | Application of heat, 130–140° C. | Black image, very low background development |
| 10 | 16 | Application of heat, 130–150° C. | Blue image |
| 11 | 18 | Exposure to acetone vapor | Blue image |
| 12 | 20 | Application of heat, 100° C. | Blue image |

The invention being thus described, it will be obvious that the same may be varied in many ways. Such variations are not to be regarded as a departure from the spirit and scope of the invention and all such modifications are intended to be included within the scope of the following claims.

What is claimed is:

1. A dielectric record material which comprises:

(a) an electrically conductive substrate and (b) an electrically insulating coating on the surface of the substrate comprising dielectric polymer material and a color-forming composition comprising:

(i) at least one basic chromogenic material; and (ii) phenolic material selected from the group consisting of phthaleins and resorcinol monobenzoate which will react with said chromogenic material to form a fixed colored mark upon application of a substantially colorless toner comprising a material which will provide mutual solution or co-melting of said reactants in selective areas of the record material upon the application of heat or solvent vapors.

2. The record material of claim 1 in which the chromogenic material is selected from the group consisting of phthalides, pyridinones and fluorans.

3. The record material of claim 2 in which the chromogenic material is selected from the group consisting of Crystal Violet Lactone, Indolyl Red, Pyridyl blue and N-102.

4. The record material of claim 3 in which the phenolic material is a phthalein.

5. The record material of claim 4 in which the phthalein is phenolphthalein.

6. The record material of claim 5 in which the chromogenic material is Pyridyl Blue.

7. The record material of claim 6 in which the chromogenic material further includes N-102.

8. The record material of claim 5 in which the chromogenic material is Crystal Violet Lactone.

9. The record material of claim 8 in which the chromogenic material further includes N-102.

10. The record material according to claim 6, 7, 8 or 9 wherein the dielectric polymer material is an acrylic latex emulsion.

11. The record material of claim 10 in which the dielectric polymer material further includes carboxylated vinyl acetate copolymer.

* * * * *